United States Patent [19]
Metz
[11] 4,076,187
[45] Feb. 28, 1978

[54] ATTITUDE-CONTROLLING SYSTEM AND A MISSILE EQUIPPED WITH SUCH A SYSTEM

[75] Inventor: Pierre Metz, Paris, France
[73] Assignee: Thomson-Brandt, Paris, France

[21] Appl. No.: 707,029
[22] Filed: Jul. 20, 1976
[30] Foreign Application Priority Data
Jul. 29, 1975 France ..... 75 23642
[51] Int. Cl.[2] ..... F42B 13/30
[52] U.S. Cl. ..... 244/3.23
[58] Field of Search ..... 244/3.23, 3.21, 3.28, 244/3.15

[56] References Cited

U.S. PATENT DOCUMENTS

| | | | |
|---|---|---|---|
| 2,611,317 | 9/1952 | Africano | 244/3.23 |
| 3,067,681 | 12/1962 | Beman | 244/3.23 |
| 3,111,088 | 11/1963 | Fisk | 244/3.23 |
| 3,132,590 | 5/1964 | Hall | 244/3.15 |

*Primary Examiner*—Charles T. Jordan
*Attorney, Agent, or Firm*—Edwin E. Greigg

[57] ABSTRACT

A system for controlling the attitude of a cylindrical body moving in a fluid, including controlling the attitude of this body in roll, which is applicable to controlling the roll of projectiles, rockets and missiles.

The system includes a finned rotary empennage concentric with the body, a torque-transmitting means connecting the body and the empennage, and an attitude detector means mounted integral with the body. The attitude detector means produces an electrical signal which is proportional to the divergence of the actual and desired attitude of the body. This signal is amplified and applied to the torque-converting means which changes the rotation of the empennage relative to the body, to thereby correct the attitude of the body by such relative rotation and the dynamic force exerted on the fins of the empennage by the fluid in which the body is moving.

8 Claims, 2 Drawing Figures

ATTITUDE-CONTROLLING SYSTEM AND A MISSILE EQUIPPED WITH SUCH A SYSTEM

BACKGROUND OF THE INVENTION

1. Field of the Invention

The invention relates to a system for controlling the attitude of a cylindrical body moving in a fluid, and more particularly to a system for controlling roll and its application to missiles. The roll-controlling system of the invention employs the fluid dynamic reaction forces set up by a rotating empennage.

2. Description of the Prior Art

In the text, the term "missile" is to be understood in its generic sense, which covers, inter alia, projectiles, rockets, and propelled or unpropelled missiles whose trajectory may or may not be controlled.

When a missile is moving in a fluid medium, either gas or liquid, it naturally tends to pivot about its longitudinal axis, also known as its roll axis, which axis is substantially coincident with the speed vector along the trajectory. This rotating movement is induced, when the missile is moving, by parasitic hydrodynamic or aerodynamic moments and/or thrust moments. These parasitic moments are due to constructional imperfections. The direction and magnitude of this rotational movement, or natural roll, are determined by the direction and magnitude of the resultant of the parasitic moments.

In certain missile firing applications, the attitude of the missile in roll needs to be positionally controlled and held by servo-control in a given direction, for example, when the missile is equipped with an auto-pilot or a military homing head. In other applications, on the other hand, it is desirable for the body of the missile to have imparted to it a rotary movement whose speed needs to be controlled within a more or less restricted range, for example, with the object of enabling a detector carried by the missile to operate at a known scanning frequency.

Techniques for controlling the attitude of missiles are widely known, in particular those which use aerodynamic control surfaces derived from the control surfaces of aircraft. Mention may be made of ailerons carried by the wings and canard control surfaces positioned at the front of the fuselage. A very different technique uses the reaction forces resulting from the expulsion of gases. These various techniques give rise to problems when the missiles are employed operationally in applications which involve special conditions of storage, handling and launching, in particular when this latter operation is performed from within a cylindrical tube or by gun-barrel effect.

OBJECT AND SUMMARY OF THE INVENTION

The object of the invention is an attitude controlling system which employs the anti-roll torque setup by a rotating empennage and its application to controlling the roll of the body of a missile. Such a system is chiefly formed by a rotating empennage concentric with the body whose attitude it is desired to control. The system is applicable to any cylindrical body moving in a fluid. The connection between the empennage and the body is provided by a torque transmitter.

The following description, which refers to the accompanying drawings, describes a plurality of embodiments of the invention by way of entirely non-limiting example.

DESCRIPTION OF THE PREFERRED EMBODIMENTS

Figure 1:
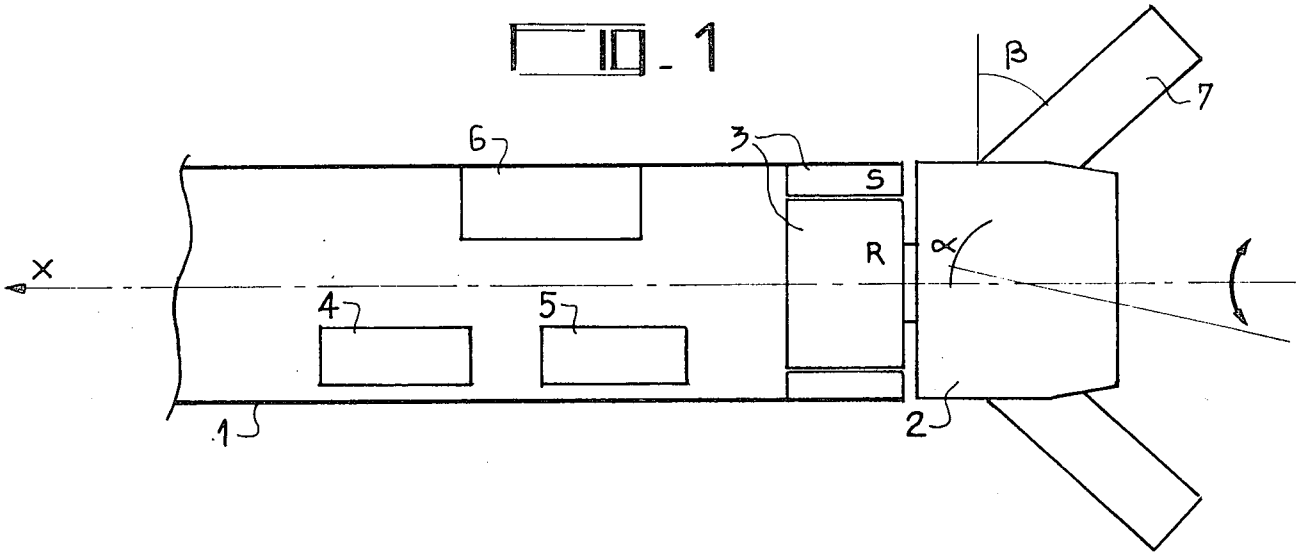
FIG. 1 is a diagram which shows the basic principles of the invention.

In all the figures the same reference numerals indicate similar components.

FIG. 1 shows the elements of the invention in a simplified and schematic form. There can be seen the body 1 of a missile of which it is desired to control the attitude in roll and an empennage 2 which is able to rotate freely about an axis X. The connection between parts 1 and 2 is provided by a torque motor 3 which consists of a rotor R and a stator S. Within the body 1 are mounted the known elements of servo-control means, namely an attitude detector 4, an amplifier unit 5 and an electrical power supply 6.

The fins 7 of the rotary empennage 2 are characterized by the angle $\alpha$ at which they are set, i.e., the angle which the plane of the fins 7 makes with axis X, and by their angle of sweep-back $\beta$, i.e., the angle which the edge of the fins 7 makes with the perpendicular and with axis X, and also by their length and width. The angle $\alpha$ at which the fins 7 are set is of a fixed value between 0° and 5°.

The method of operation is as follows: the missile is moving in a fluid in direction X when the attitude detector 4, which may be gyroscopic for example, detects that the body 1 of the missile is rolling. It gives out an electrical signal proportional to the divergence measured. This divergence signal is amplified by the amplifier unit 5 and is applied to the rotor of the torque transmitter 3. The size of the restoring torque produced depends on the aerodynamic effectiveness of the fins 7 on the relative speed of movement of the missile and on the amount of divergence from the correct attitude. When the fins 7 are mounted on a pivot, they are able to be unfolded. The rotary empennage 2 and the associated components 4, 5, 6 form a means of servo-controlling position or speed, depending upon the desired application. In an example where speed is controlled, the attitude detector 4 is a rate gyro. The torque transmitter 3 may, inter alia, be a torque motor, an electromagnetic clutch, or an alternator. The stability of the servo-control means is determined by the transfer function of the components 4, 5 and 6 associated with the rotary empennage 2 as a whole. It is well-known to those skilled in servo-mechanisms how to obtain the characteristics of these components and more particularly those of the correcting electrical circuits inserted in the chain of control.

Figure 2:
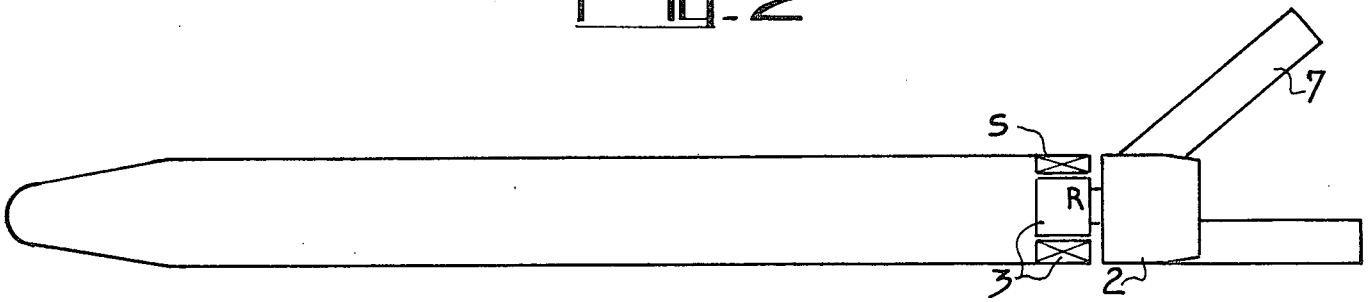
FIG. 2 is a diagrammatic cross-section showing the application of the attitude controlling system to a roll-stabilized missile.

FIG. 2 is a sectional view of the system of the invention when applied to a roll-controlled missile. The rotary empennage 2 and its torque transmitter 3 are built into the base of the missile. The rotational independence between the body 1 of the missile and the empennage 2 is improved by using ball-bearings which are not shown. The fins 7, which are between 4 and 8 in number in practice, are advantageously of the unfoldable type.

The torque transmitter 3 is an electrical torque motor whose field circuit S is formed by a permanent magnet attached to the inside of the body 1 of the missile. The rotor R connected to the rotary empennage 2 receives the torque generating current via a brush-type collector (not shown). The components forming the associated parts of the servo-control means, such as the attitude detector 4, the amplifier unit 5 and the source 6 of electrical energy are located within the body 1 of the missile. The auxiliary operations of starting, unlocking and uncaging the gyroscope are as currently employed during the launching phase of missiles.

Figure 3:
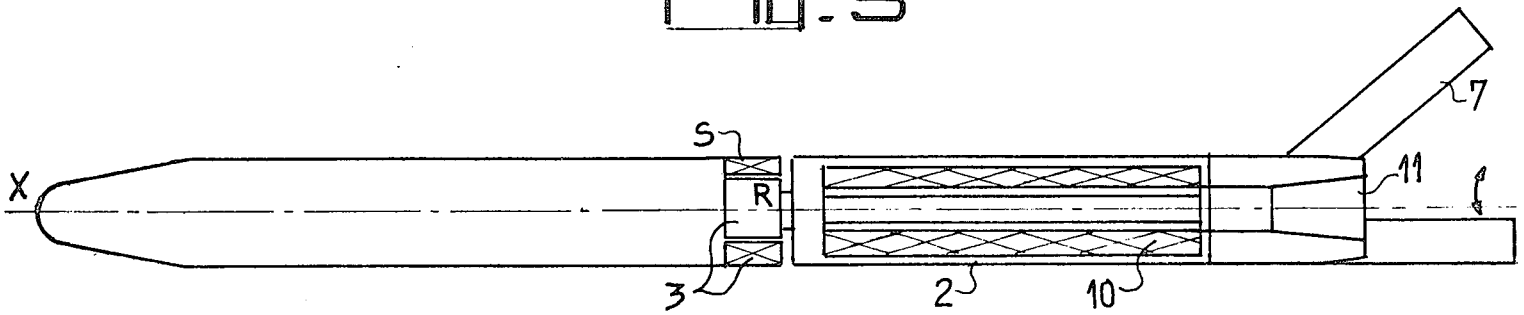
FIG. 3 shows a modified embodiment applied to a missile equipped with means of propulsion.

FIG. 3 shows a modification of the previous application.

The sectional view shows the application of the system of the invention to a missile equipped with propulsion means 10. The fins 7 of the rotary empennage 2 are situated at the point where the nozzle 11 of the propulsion means 10 is situated. They may be of the unfoldable type.

Figure 4:
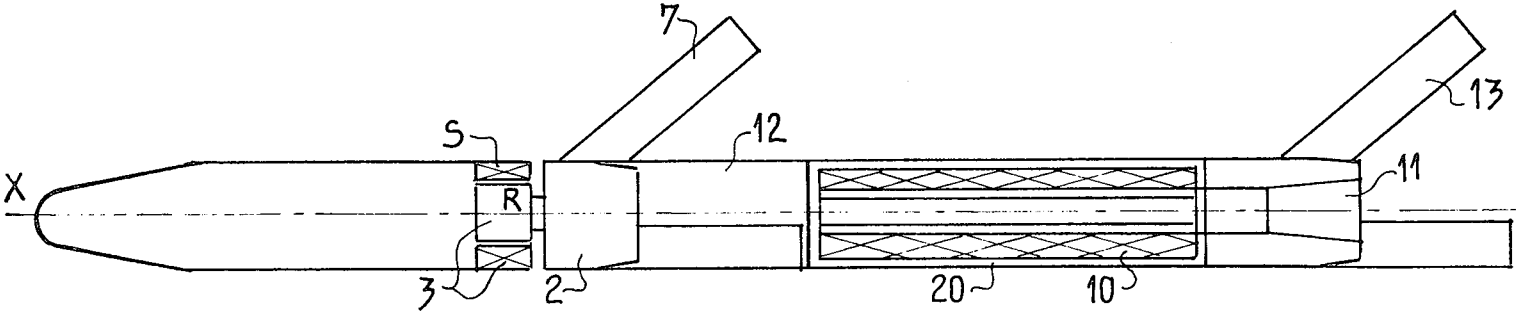
FIG. 4 shows a modified embodiment applied to a missile equipped with jettisonable propulsion means.

FIG. 4 shows a modified application of the invention in the case of a type of missile equipped with a jettisonable propulsion stage 20. The propulsion stage 20, which is secured to the rotary empennage 2 of the missile stage proper, incorporates seatings 12 for the foldable fins 7 and an additional set of fins 13 situated near the nozzle 11.

When the missile is launched, the fins 13 situated in the vicinity of the nozzle 11 are unfolded and the fins 7 of the missile stage are held captive by the propulsion stage 20. At the end of the combustion period, the propulsion stage 20 is automatically jettisoned, thus freeing the fins 7 of the missile stage.

The system of the invention has a number of positive advantages over known systems. In particular it enables the roll of the body to be controlled using a single servo-control. The axial layout of the parts gives constructional strength, thus allowing launching by gun-barrel effect. The system is compatible with different designs of missile, certain of which are illustrated by way of example in FIGS. 2, 3 and 4.

The present invention and its application to missiles has however been described and illustrated simply by way of non-limiting explanation.

What is claimed is:

1. A system for controlling the attitude of a cylindrical body moving in a fluid, capable of controlling the attitude of this body in roll, which comprises:

a finned rotary empennage concentric with the body;

a bi-directional torque transmitter providing a connection between the body and the empennage and acting on the empennage relative to the body;

an attitude detector means for producing a signal proportional to the divergence between the detected and desired attitudes of the body;

an amplifier means for amplifying said signal, said torque transmitter being connected to be driven by the amplified signal produced by said amplifier means; and a source of electrical energy for powering said amplifier and said bi-directional torque transmitter.

2. A system according to claim 1, in which the fins of the empennage are set in position on the cylindrical part of the empennage so as to form a substantially zero angle with the longitudinal axis of the body.

3. A system according to claim 1, in which the fins of the empennage are set in position on the cylindrical part of the body, at an angle to the longitudinal axis of the body which is other than zero and is between zero and five degrees.

4. A system according to claim 1, wherein said torque transmitter is an electrical torque motor.

5. A system according to claim 1, wherein the fins of the empennage are foldable fins which can be folded into the cylindrical part of the empennage prior to firing, that is, setting the body in motion, and unfolded upon firing.

6. A missile which includes a system for controlling the attitude of the missile when the missile is moving in a fluid, said system being capable of controlling the attitude of the missile in roll and comprising:

a finned rotary empennage concentric with the missile;

a bi-directional torque transmitter providing a connection between the missile and the empennage and acting on the empennage relative to the missile;

an attitude detector means for producing a signal proportional to the divergence between the detected and desired attitudes of the missile;

an amplifier means for amplifying said signal, said torque transmitter being connected to be driven by the amplified signal produced by said amplifier means; and a source of electrical energy for powering said amplifier and said bi-directional torque transmitter.

7. A missile according to claim 6, wherein the rotary empennage, includes propulsion means which maintain a predetermined speed of the missile or bring it to said speed.

8. A missile which includes a system for controlling the attitude of the missile when the missile is moving in a fluid, said system being capable of controlling the attitude of the missile in roll and comprising:

a finned rotary empennage concentric with the missile having propulsion means which maintains a predetermined speed of the missile or brings said missile to said speed, said empennage comprises a first jettisonable portion which includes said propulsion means and a first set of foldable fins which can be unfolded upon firing of the missile, and a second non-jettisonable portion which includes a second set of foldable fins, which are held in the folded position by the first jettisonable portion and unfolded when the first portion is jettisoned, thus ensuring that the attitude of the missile can be controlled both before and after the first portion of the empennage is jettisoned;

a torque transmitter providing a connection between the missile and the empennage and acting on the empennage relative to the missile;

an attitude detector means for producing a signal proportional to the divergence between the detected and desired attitudes of the missile;

an amplifier means for amplifying said signal, said torque transmitter being connected to be driven by the amplifier signal produced by said amplifier means.

* * * * *